US007996920B2

(12) United States Patent
Aldridge

(10) Patent No.: US 7,996,920 B2
(45) Date of Patent: Aug. 16, 2011

(54) PROTECTIVE GARMENT WITH REMOVABLE PORTIONS

(75) Inventor: Donald Aldridge, New Carlisle, OH (US)

(73) Assignee: Lion Apparel, Inc., Dayton, OH (US)

( * ) Notice: Subject to any disclaimer, the term of this patent is extended or adjusted under 35 U.S.C. 154(b) by 133 days.

(21) Appl. No.: 12/421,666

(22) Filed: Apr. 10, 2009

(65) Prior Publication Data

US 2009/0255029 A1 Oct. 15, 2009

Related U.S. Application Data

(60) Provisional application No. 61/043,946, filed on Apr. 10, 2008.

(51) Int. Cl.
*A62B 17/00* (2006.01)
*A62B 13/00* (2006.01)
*A41D 13/00* (2006.01)

(52) U.S. Cl. ..... 2/69; 2/200.2; 2/168

(58) Field of Classification Search ..... None
See application file for complete search history.

(56) References Cited

U.S. PATENT DOCUMENTS

| | | | | |
|---|---|---|---|---|
| 2,813,272 | A | 11/1957 | Hagan | |
| 3,312,982 | A | 4/1967 | Pitman | |
| 4,543,670 | A | 10/1985 | Ehring | |
| 4,631,753 | A | 12/1986 | Ehring | |
| 4,782,534 | A | 11/1988 | Grilliot et al. | |
| 4,864,742 | A | 9/1989 | Grilliot et al. | |
| 4,941,213 | A | 7/1990 | Grilliot et al. | |
| 4,999,850 | A | 3/1991 | Grilliot et al. | |
| 5,090,057 | A | 2/1992 | Aldridge | |
| 5,208,919 | A | 5/1993 | Fields | |
| 5,274,850 | A | 1/1994 | Aldridge | |
| 5,388,270 | A | 2/1995 | Hewitt | |
| 5,873,132 | A | 2/1999 | Grilliot et al. | |
| 6,134,717 | A | 10/2000 | Grilliot et al. | |
| 6,336,223 | B1 | 1/2002 | Snedeker | |
| 6,409,858 | B1 * | 6/2002 | Popp et al. | 156/66 |
| 7,404,213 | B2 | 7/2008 | Lieberman | |
| 7,448,093 | B1 * | 11/2008 | Ruck | 2/457 |
| 7,461,468 | B2 | 12/2008 | Grilliot et al. | |
| 2003/0009144 | A1 * | 1/2003 | Tanzer et al. | 604/391 |
| 2003/0018315 | A1 * | 1/2003 | Popp et al. | 604/386 |
| 2003/0051802 | A1 * | 3/2003 | Hargett et al. | 156/256 |
| 2008/0256677 | A1 * | 10/2008 | Loos | 2/69 |
| 2009/0312730 | A1 * | 12/2009 | Lavon et al. | 604/365 |
| 2010/0212061 | A1 * | 8/2010 | Luciano | 2/84 |

FOREIGN PATENT DOCUMENTS

DE 102005045820 9/2006

(Continued)

OTHER PUBLICATIONS

PCT, International Search Report and Written Opinion, International Application No. PCT/US2009/040145; 15 pages. (Feb. 22, 2010).

(Continued)

*Primary Examiner* — Bobby H Muromoto, Jr.
(74) *Attorney, Agent, or Firm* — Thompson Hine LLP

(57) ABSTRACT

A protective garment including a first portion which is generally impermeable to gases and a second portion which is generally impermeable to gases. The second portion is releasably coupled to the first portion at a joint which is generally impermeable to gases.

38 Claims, 20 Drawing Sheets

FOREIGN PATENT DOCUMENTS

| | | |
|---|---|---|
| EP | 1788899 | 5/2007 |
| FR | 2801769 | 6/2001 |
| GB | 974426 | 11/1964 |
| WO | 00/30481 | 6/2000 |

OTHER PUBLICATIONS

"Chempak™ Products. Enhanced Functionality in Chemical and Biological Environments," by W.L. Gore & Associates, Inc. (4 pages) (2007).

"User Instruction, Safety and Training Guide. Lion Apparel NFPA 1994 Class 2 and NFPA 1992 Ensemble," by Lion Apparel (36 pages) (Mar. 2007).

"Technical Data Package. Lion Apparel NFPA 1994 Class 2 and NFPA 1992 Ensemble," by Lion Apparel (4 pages) (Apr. 2007).

PCT, International Preliminary Report on Patentability, International Application No. PCT/US2009/040145; (Oct. 21, 2010).

* cited by examiner

PROTECTIVE GARMENT WITH REMOVABLE PORTIONS

This application claims priority to U.S. Provisional Application Ser. No. 61/043,946, filed on Apr. 10, 2008, the entire contents of which are hereby incorporated by reference.

BACKGROUND

Protective or hazardous duty garments are used in a variety of industries and settings to protect the wearer from adverse conditions such as heat, flames, smoke, cold, sharp objects, chemicals, liquids, vapors, fumes and the like. Accordingly, such garments may be prone to damage, wear, weakening, etc. Moreover, such damage, wear, weakening or the like can often occur in the extremities of the garment (i.e. the arms and/or legs) since the extremities may be the most exposed part of the garment.

SUMMARY

In one embodiment, the present invention is a protective garment with extremities or other portions that are removable or separable so that the various portions can be serviced, replaced or repaired as they become damaged, worn, or weakened. In particular, in one embodiment the invention is a protective garment including a first portion which is generally impermeable to gases and a second portion which is generally impermeable to gases. The second portion is releasably coupled to the first portion at a joint which is generally impermeable to gases

DETAILED DESCRIPTION

Figure 1:
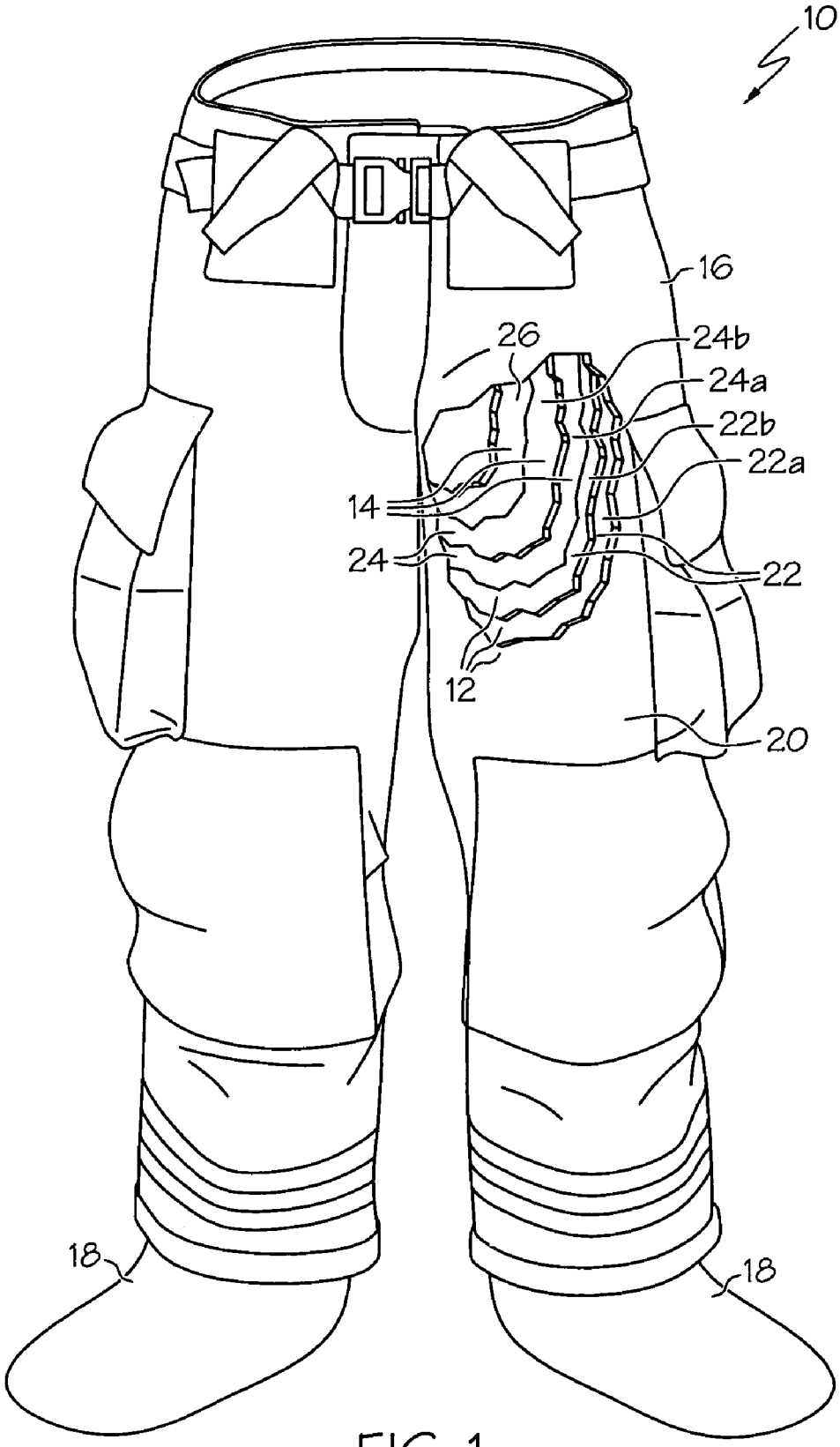
FIG. 1 is a front perspective view of a pair of trousers, with certain portions cut away to expose various layers thereof.
Figure 2:
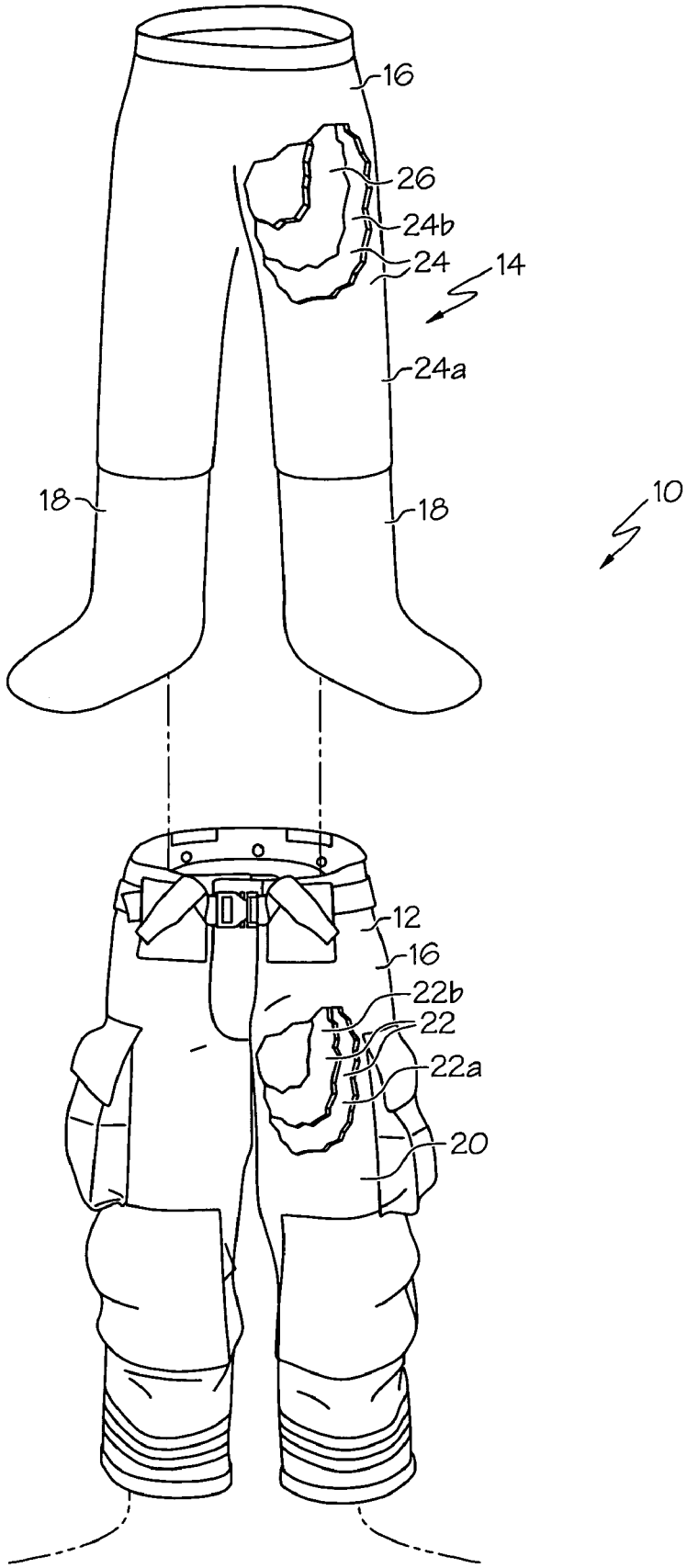
FIG. 2 is an exploded view the trousers of FIG. 1.

FIGS. 1 and 2 illustrate one embodiment of a protective or hazardous duty garment in the form of a pair of firefighter's trousers, generally designated 10. The trousers 10 may include an outer liner 12 and an (optionally) removable or separable inner shell 14 positioned between the outer liner 12 and a wearer of the garment. The trousers 10 may include a body portion/upper leg portion 16 configured to receive the lower part of the torso and the upper part of the legs of a wearer. In the illustrated embodiment, the trousers 10, and in particular the inner shell 14, may also include a pair of removable/detachable extremities or lower leg portions 18 configured to receive the lower part of the leg of a wearer. In the illustrated embodiment, the lower leg portions 18 of the inner shell 14 are releasably or detachably coupled to the body portion 16 of the inner shell 14.

The trousers 10 may include various layers through its thickness to provide various heat, moisture and abrasion resistant qualities to the trousers 10 so that the trousers 10 can be used as a protective, hazardous duty, and/or firefighter garment. For example, the trousers 10 may include an outer shell 20, a thermal liner or barrier 22 located inside of and adjacent to the outer shell 20, a gas barrier/vapor barrier/moisture barrier 24 located inside of and adjacent to the thermal barrier 22, and an inner liner or inner face cloth 26 is located inside of and adjacent to the moisture barrier 24. Additional liners, layer and the like (not shown) may be included as desired.

The outer shell 20 may be made of or include a variety of materials, including a flame, heat and abrasion resistant material such as a compact weave of aramid fibers and/or polybenzamidazole fibers. Commercially available aramid materials include NOMEX and KEVLAR fibers (both trademarks of E.I. DuPont de Nemours & Co., Inc. of Wilmington, Del.), and commercially available polybenzamidazole fibers include PBI fibers (a trademark of PBI Performance Fabrics of Charlotte, N.C.). Thus, the outer shell 20 may be an aramid material, a blend of aramid materials, a polybenzamidazole material, a blend of aramid and polybenzamidazole materials, or other appropriate materials. If desired, the outer shell 20 may be coated with a polymer, such as a durable, water repellent finish (i.e. a perfluorohydrocarbon finish, such as TEFLON® finish sold by E. I. Du Pont de Nemours and Company of Wilmington, Del.). The materials of the outer shell 20 may have a weight of, for example, between about five and about ten oz/yd$^2$.

The thermal liner 22 and moisture barrier 24 may be generally coextensive with the outer shell 20, or spaced slightly inwardly from the outer edges of the outer shell 20 (i.e., spaced slightly inwardly from the upper ends of the waist and from the lower edge of the trousers 10) to provide moisture and thermal protection throughout the trousers 10. The thermal liner 22 may be made of nearly any suitable material that provides sufficient thermal insulation. In one embodiment, the thermal liner 22 may constitute or include a relatively thick (i.e. between about 1/16"-3/16") batting, felt or needled non-woven bulk or batting material 22*a*. The bulk material 22*a* can also take the form of one or two (or more) layers of E-89® spunlace fabric made of a combination of NOMEX® and KEVLAR® fabric. The bulk material 22*a* can also, or instead, include aramid fiber batting (such as NOMEX® batting), aramid needlepunch material, an aramid non-woven material, an aramid blend needlepunch material, an aramid blend batting material, an aramid blend non-woven material, foam (either open cell or closed cell), or other suitably thermally insulating materials. The bulk material 22*a* may trap air and possess sufficient loft to provide thermal resistance to the trousers 10.

The bulk material 22*a* may be quilted to a thermal liner face cloth 22*b* which can be a weave of a lightweight aramid material. Thus, either the bulk material 22*a* alone, or the bulk material 22*a* in combination with the thermal liner face cloth 22*b*, may be considered to constitute the thermal liner 22. In the illustrated embodiment, the bulk material 22*a* is located between the outer shell 20 and the thermal liner face cloth 22*b*. However, the orientation of the thermal liner 22 may be reversed such that the thermal liner face cloth 22*b* is located between the outer shell 20 and the bulk material 22*a*. If desired, the thermal liner 22 may be treated with a water-resistant or water-repellent finish.

In one embodiment, the thermal liner 22 may have a thermal protection performance ("TPP") of at least about twenty, and in another embodiment, at least about thirty five. Moreover, in one embodiment the trousers 10 as a whole has a TPP of at least about twenty, and in another embodiment has a TPP of at least about thirty-five.

The moisture barrier 24 may include a semi-permeable membrane layer 24*a*. The membrane layer 24*a* may be generally water vapor permeable but generally impermeable to liquid moisture. The membrane layer 24*a* may be made of or include expanded polytetrafluoroethylene ("PTFE") such as GORE-TEX or CROSSTECH materials (both of which are trademarks of W.L. Gore & Associates, Inc. of Newark, Del.), polyurethane-based materials, neoprene-based materials, cross-linked polymers, polyamid, GORE® CHEMPAK® materials, sold by W.L. Gore & Associates, Inc. including GORE® CHEMPAK® Ultra Barrier Fabric, GORE® CHEMPAK® Selectively Permeable Fabric, or GORE® CHEMPAK® Sorptive Fabric, or other materials.

The membrane layer 24*a* may have microscopic openings that permit moisture vapor (such as water vapor) to pass therethrough, but block liquids (such as liquid water) from passing therethrough. The membrane layer 24*a* may be made of a microporous material that is either hydrophilic, hydrophobic, or somewhere in between. The membrane layer 24*a* may also be monolithic and may allow moisture vapor transmission therethrough by molecular diffusion. The membrane layer 24*a* may also be a combination of microporous and monolithic materials (known as a bicomponent moisture barrier), in which the microporous or monolithic materials are layered or intertwined.

The membrane layer 24*a* may be bonded, adhered or otherwise attached to a substrate 24*b* of a flame and heat resistant material to provide structure and protection to the membrane layer 24*a*. The substrate 24*b* may be or include aramid fibers similar to the aramid fibers of the outer shell 20, but may be thinner and lighter in weight. The substrate 24*b* may be woven, non-woven, spunlace or other materials. If desired, and in certain embodiments, the moisture barrier 24 may lack a substrate 24*b*, or may include a substrate 24*b* on both sides of the membrane layer 24*a*.

In FIGS. 1 and 2 the thermal liner 22 is shown as being positioned between the outer shell 20 and the moisture barrier 24. However, if desired, and for use in certain applications, the positions of the moisture barrier 24 and thermal liner 22 may be reversed such that the moisture barrier 24 is located between the outer shell 20 and the thermal liner 22. In addition, FIGS. 1 and 2 illustrate the substrate 24*b* as being positioned between the membrane layer 24*a* and the inner face cloth 26. However, the orientation of the moisture barrier 24 may be reversed such that the membrane layer 24*a* is positioned between the substrate 26*b* and the inner liner 26.

The trousers 10 may include the inner face cloth 26 which may be the innermost layer of the trousers 10. The inner face cloth 26 can provide a comfortable surface for the wearer and protect the moisture barrier 24 and/or thermal liner 22 from abrasion and wear.

The trousers 10 may include various arrangements of liners/materials, as desired, in which the various layers described herein are included, omitted, and/or rearranged. For example, the trousers 10 may lack any thermal liner 22, and include only an outer shell 20, moisture/vapor barrier 24 and inner face cloth 26, or may include only an outer shell 20 and inner face cloth 26, or may include only an outer shell 20, or may include only a moisture/vapor barrier 24, or may take on various other configurations as desired.

Each layer of the garment/trousers 10, and the garment/trousers 10 as a whole, may meet the National Fire Protection Association ("N.F.P.A.") 1971 standards for protective firefighting garments ("Protective Clothing for Structural Firefighting"), which are entirely incorporated by reference herein. The NFPA standards specify various minimum requirements for heat/flame resistance and tear strength. For example, in order to meet the NFPA standards, the garment 10 must be able to resist igniting, burning, melting, dripping, separation and/or shrinking by more than 10% in any direction at a temperature of 500° F. for at least five minutes. Furthermore, in order to meet the NFPA standards, the combined layers of the garment/trousers 10 must provide a thermal protective performance rating of at least thirty-five.

The barrier 24 can also help to prevent or reduce the introduction of harmful materials into the trousers 10. Such harmful materials may include liquids (including chemical warfare agents, biological warfare agents and toxic industrial chemicals), vapors and aerosols (including chemical warfare agents and toxic industrial chemicals), and contaminated particulates (such as biological warfare agents). Examples of chemical warfare agents include soman (GD) nerve agent and distilled mustard (HD) blister agent. Examples of toxic industrial chemicals include acrolein (liquid), acrylonitrile (liquid), ammonia (gas), choline (gas), and dimethyl sulfate (liquid).

Thus, in addition to the materials listed above, the barrier 24 may also be made of various other materials which block harmful materials, gases and/or vapors. For example, the barrier 24 may be made of made of or include PTFE (such as GORE-TEX® or CROSSTECH® materials), polyurethane or polyurethane-based materials, neoprene or neoprene-based materials, cross-linked polymers, polyamid, or GORE® CHEMPAK® materials, sold by W.L. Gore & Associates, Inc. including GORE® CHEMPAK® Ultra Barrier Fabric, GORE® CHEMPAK® Selectively Permeable Fabric, or GORE® CHEMPAK® Sorptive Fabric. Besides the materials outlined above, the barrier 24 can be made of nearly any material that is generally impermeable to a particular harmful material. In general, since gases typically are able to permeate many materials, if the barrier 24 is able to block gases, the barrier 24 may thus be able to block the other undesirable materials, such as vapors or aerosols. The various other layers of the garment 10, such as the outer shell 20, a thermal liner or barrier 22, an inner liner or inner face cloth 26, or other layers thereof, may be generally gas permeable, liquid permeable, or able to be permeated by aerosols or other harmful materials, such that the barrier 24 is relied upon to provide protection against such materials.

NFPA 1971 standards include a Chem/Bio Option (the entire contents of which are hereby incorporated by reference) which provides specifications that protective ensembles must meet in order to be certified under that Option. For example, the Chem/Bio Option specifies that the garment must pass a MIST test (Man In Simulant Test). In one case the MIST test essentially consists of introducing the garment into a chamber filled with a vaporized test material (such as oil of wintergreen). Absorbent padding is placed on the wearer and/or inside the garment. After the garment has been exposed to the vaporized material for a sufficient period of time, the garment is removed from the chamber. The absorbent pads are removed and analyzed to determine how much of the vaporized test material they have absorbed. The barrier 24, in combination with various other protective features, may provide a garment/ensemble which passes the MIST test, and which more broadly, meets the Chem/Bio Option of NFPA 1971 standards.

In the illustrated embodiment the outer liner 12 includes the outer shell 20 and the thermal liner 22 (including the bulk material 22*a* and the thermal liner face cloth 22*b*), and the inner shell 14 includes the barrier 24 (including the membrane layer 24*a* and the barrier face cloth 24*b*), and the inner face cloth 26. However, the outer liner 12 may include the outer shell 20 and various other layers as desired, such as the thermal liner 22, barrier 24, and/or other layers. Similarly, the inner shell 14 may include the inner face cloth 26 and various other layers, such as a thermal liner 22, barrier 24, face cloth 26 and/or other layers. In addition, the garment 10/trousers may lack a separable inner shell 14, and may be only a single or multi-ply garment without removable or separable layers. Moreover, the outer liner 12 and inner shell 14 may include various layers thereof, or may be made of only a single layer (including, for example, the inner shell 14 comprising solely the barrier 24). For ease of illustration, the outer liner 12 and inner shell 14 are each shown as a single layer or ply in various drawings of FIGS. 3-11, although it should be understood that those layers 12, 14 may include various layers or sub-layers as described above and shown in FIGS. 1 and 2.

As noted above, the inner shell 14 may have a pair of lower leg portions 18 in the form of "booties" 18 which are detachable from the associated body portion/upper leg portions 16 to allow the lower leg portions 18 to be removed, detached, repaired or replaced as desired. Each upper leg portion 16 may extend below the knee of the upper portion 16 so that the costs associated with replacing each bootie 18 is minimized. However, the lower (detachable) leg portion 18 can extend above knee, or take up nearly any portion or length of the leg of the trousers 10 as desired in order to provide the desired qualities to the garment.

In the illustrated embodiment, the inner shell 14 includes two-releasably coupled portions 16, 18, and the outer liner 12 is generally continuous in its entirety (i.e., lacks any releasable joints or the like), or is at least generally continuous, in the area or proximity of the joint where the portions 16, 18 are coupled together. In addition, the outer liner 12, or various portions thereof, may lack any portions that are releasably coupled together, or releasably coupled together in the manner described herein. In this case, a generally continuous outer liner 12 (or outer shell 20) is provided which continuously extends over the areas covering the wearer, and helps to protect the wearer from abrasions and reduce heat, moisture, and harmful material infiltration. However, if desired the outer liner 20, or various layers thereof (such as the outer shell 12), may have portions (i.e., booties or other portions described herein) that are releasably coupled in the manner disclosed herein. In addition, other layers of the inner shell 14, besides the barrier 24, can be releasably coupled in the manner disclosed herein.

Figure 3:
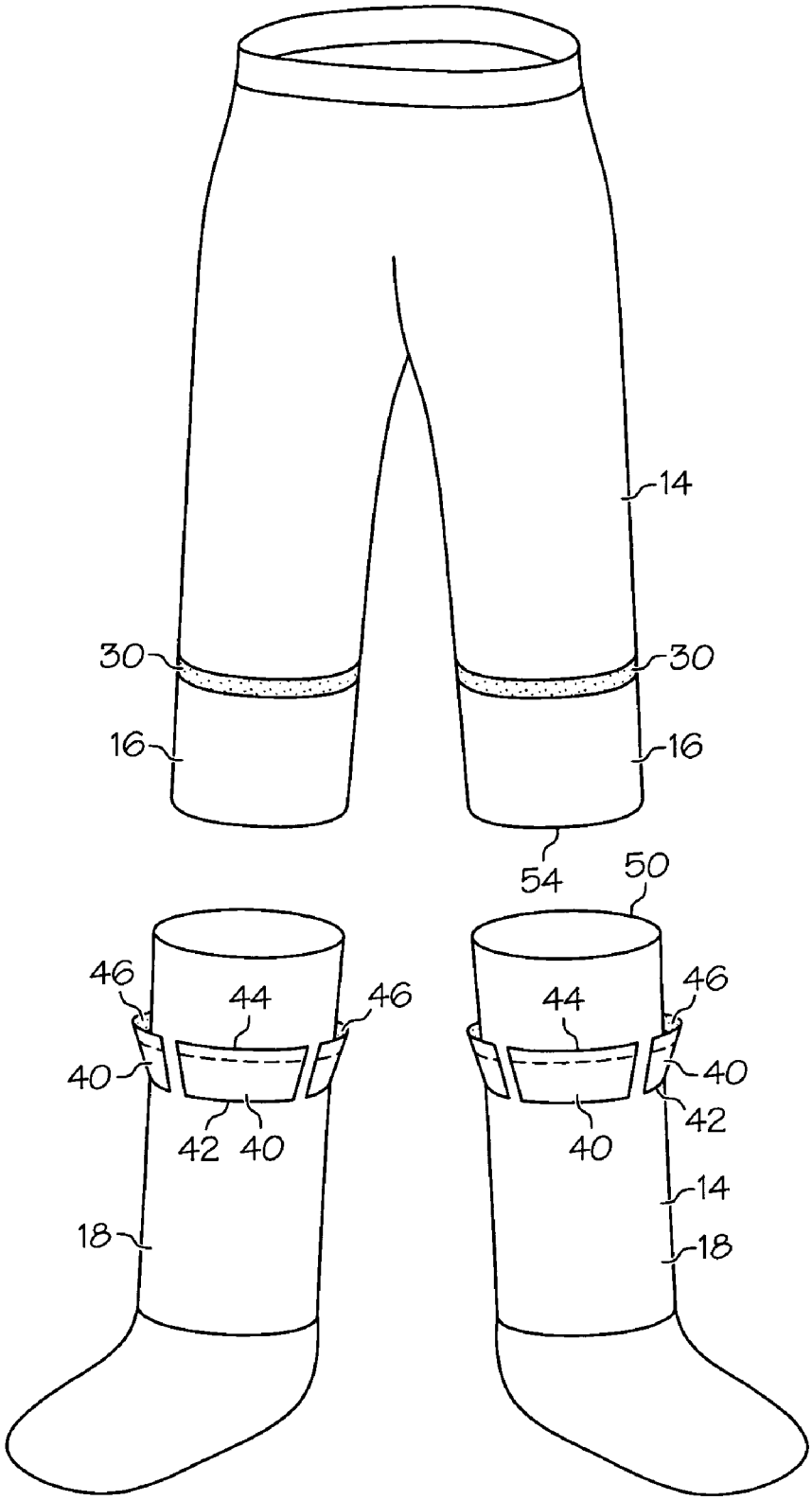
FIG. 3 is an exploded view of the trousers liner of FIG. 1.
Figure 4:
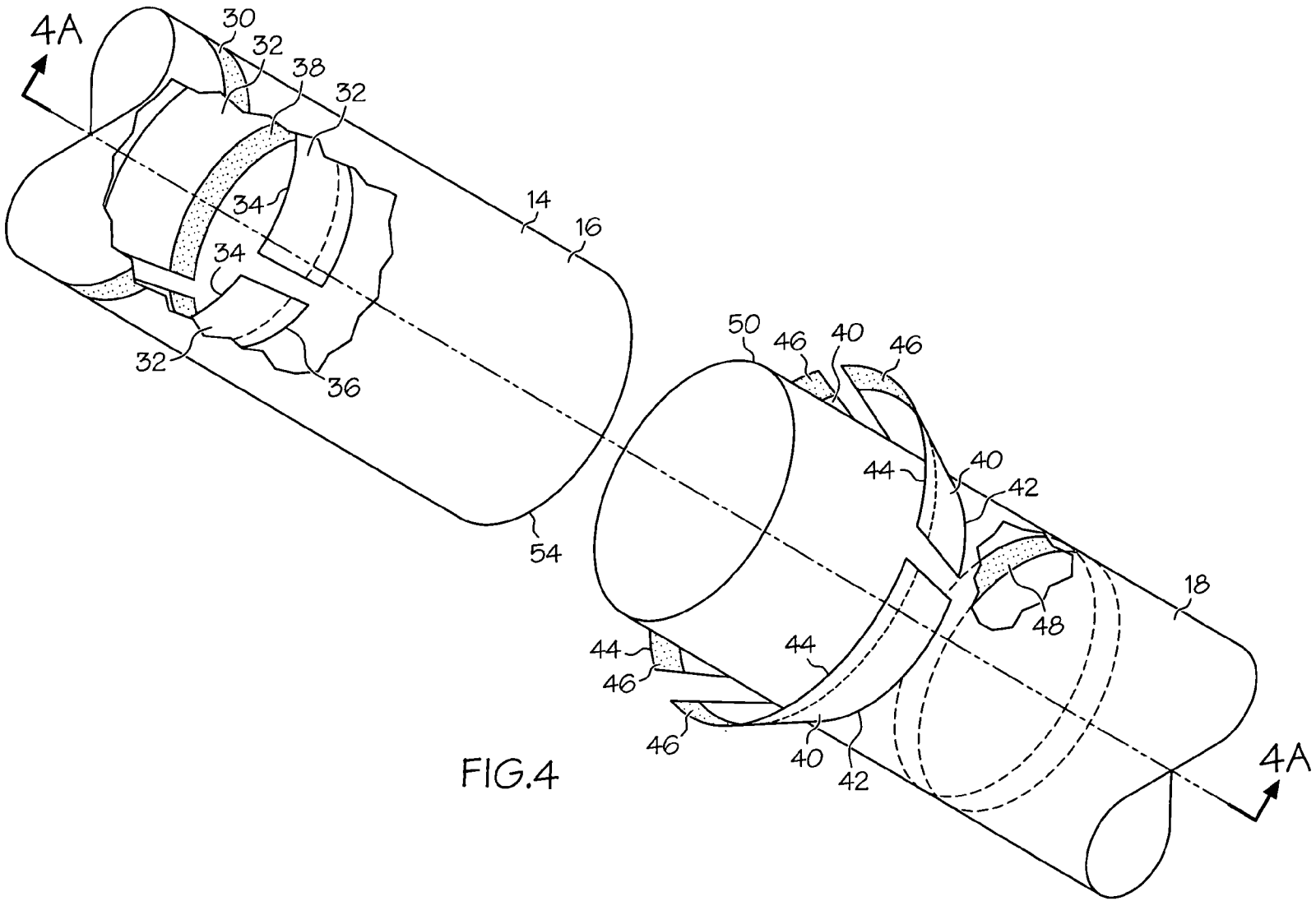
FIG. 4 is a perspective view of part of the upper and lower trouser portions of FIG. 3.
Figure 4A:
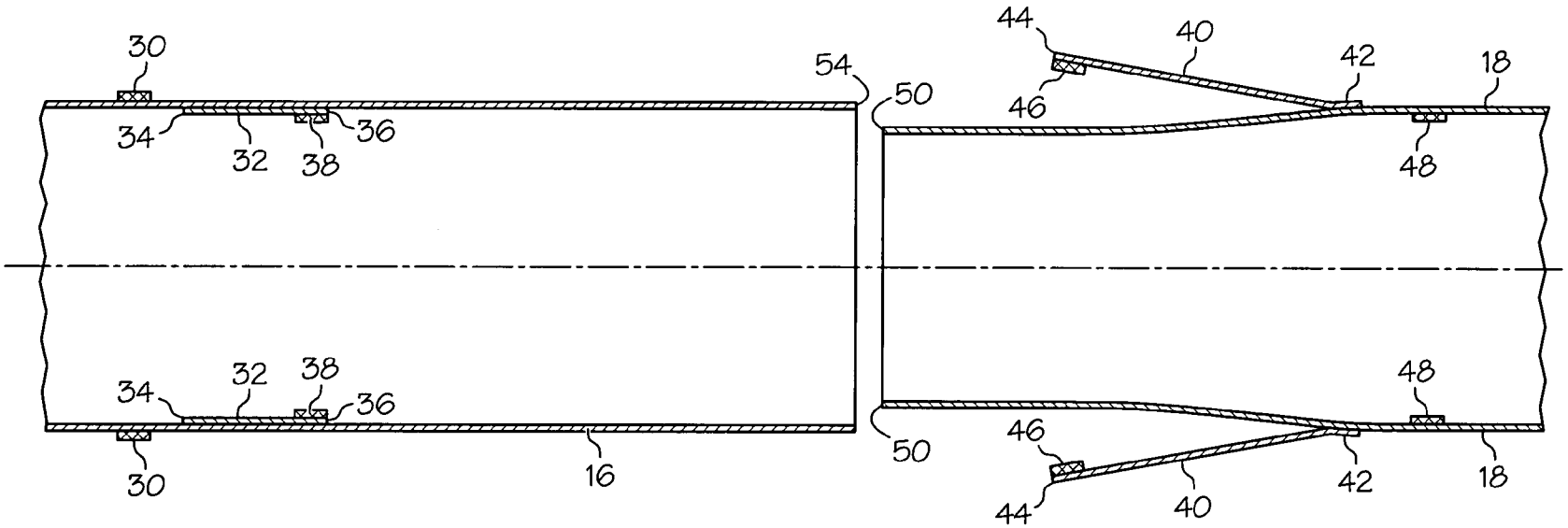
FIG. 4A is a side cross section taken along line 4A-4A of FIG. 4.

In order to form a secure air-tight/vapor-tight/moisture tight seal between the lower leg portions 18 and the upper leg portions 16, the attachment structure shown in FIGS. 3-11 and described below may be utilized. As shown in FIGS. 3, 4 and 4A, each upper leg portion 16 may include a fastening portion 30 in the form of band of hook and loop fastening material (such as VELCRO® fastening material) on its outer surface, and a set of flaps 32 (three flaps 32 in one embodiment) on its inner surface. Each flap 32 may be pivotally attached to each upper leg portion 16 along its upper edge 34, and the lower edge 36 of each flap 32 may be a free edge that is not directly attached to the upper leg portion 16. Each flap 32 may include a fastening portion 38 in the form of a strip of hook-and-loop fastening material 38 on its inner surface positioned adjacent to the lower edge 36.

Each lower leg portion 18 may include a set of flaps 40 attached to the outer surface thereof (three flaps 40 in one embodiment). Similar to the flaps 32 of the upper leg portions 16, the flaps 40 of the lower leg portions 18 may be directly attached along lower edges 42, and each upper edge 44 is a free edge that is not directly attached to the lower leg portion 18. A fastening portion 46 in the form of a strip of hook-and-loop material is positioned on the inner face of each flap 40, adjacent to the upper edge 44. A fastening portion 48 in the form of a band of hook-and-loop fastening material is positioned on the inside surface of each lower leg portion 18, at a lower position than the flaps 40.

Figure 5:
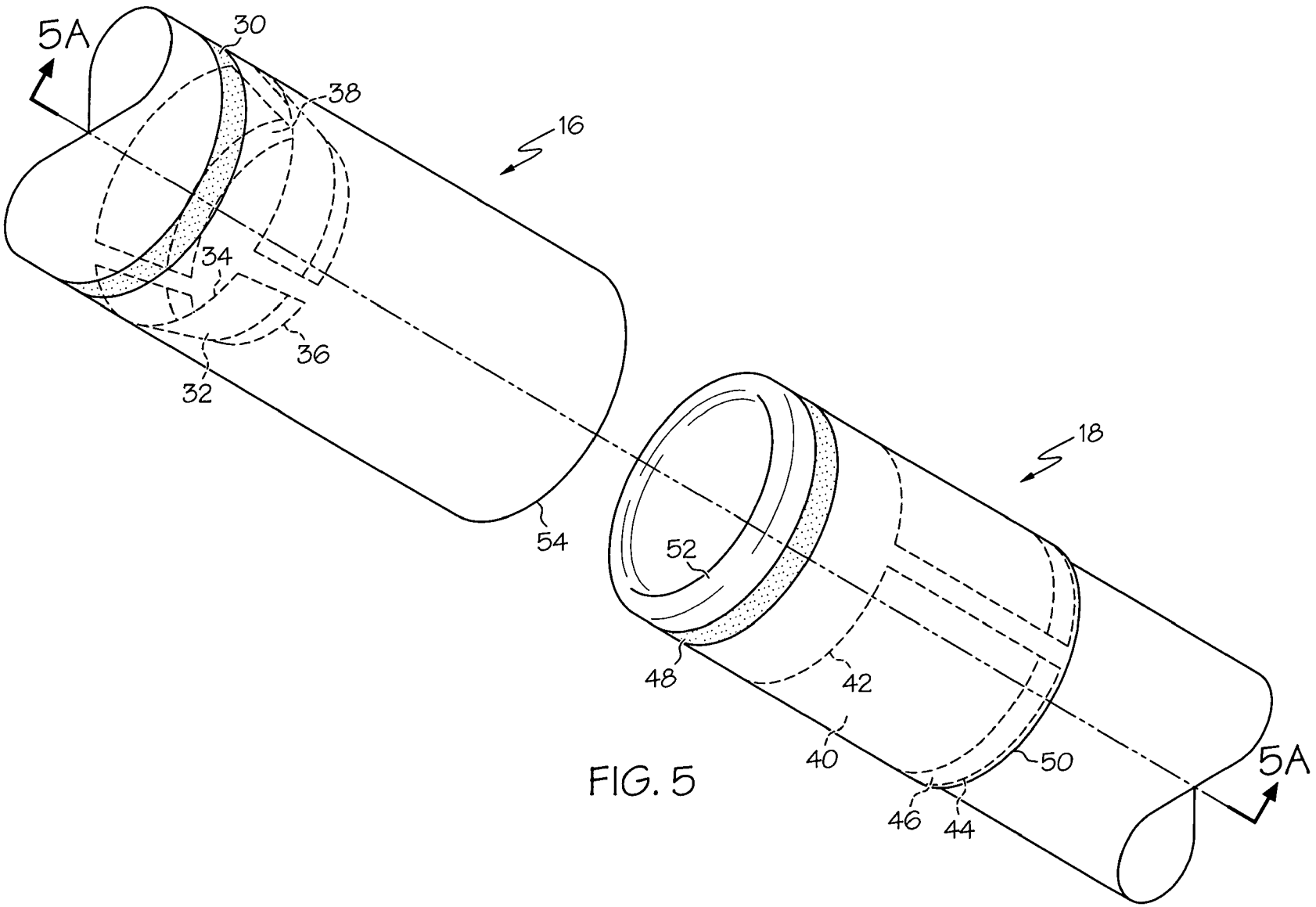
FIGS. 5-11 (and associated cross sections) illustrate a series of step that may be utilized to couple together the upper and lower trouser portions of FIG. 3.
Figure 5A:
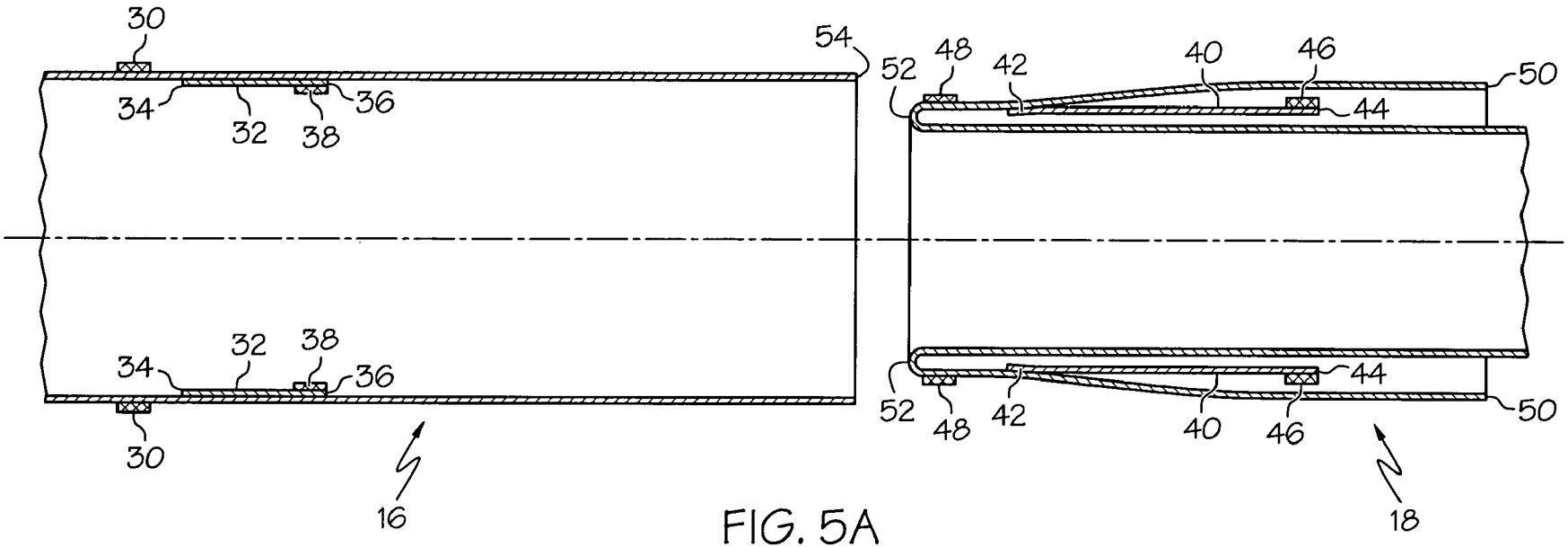
Figure 6:
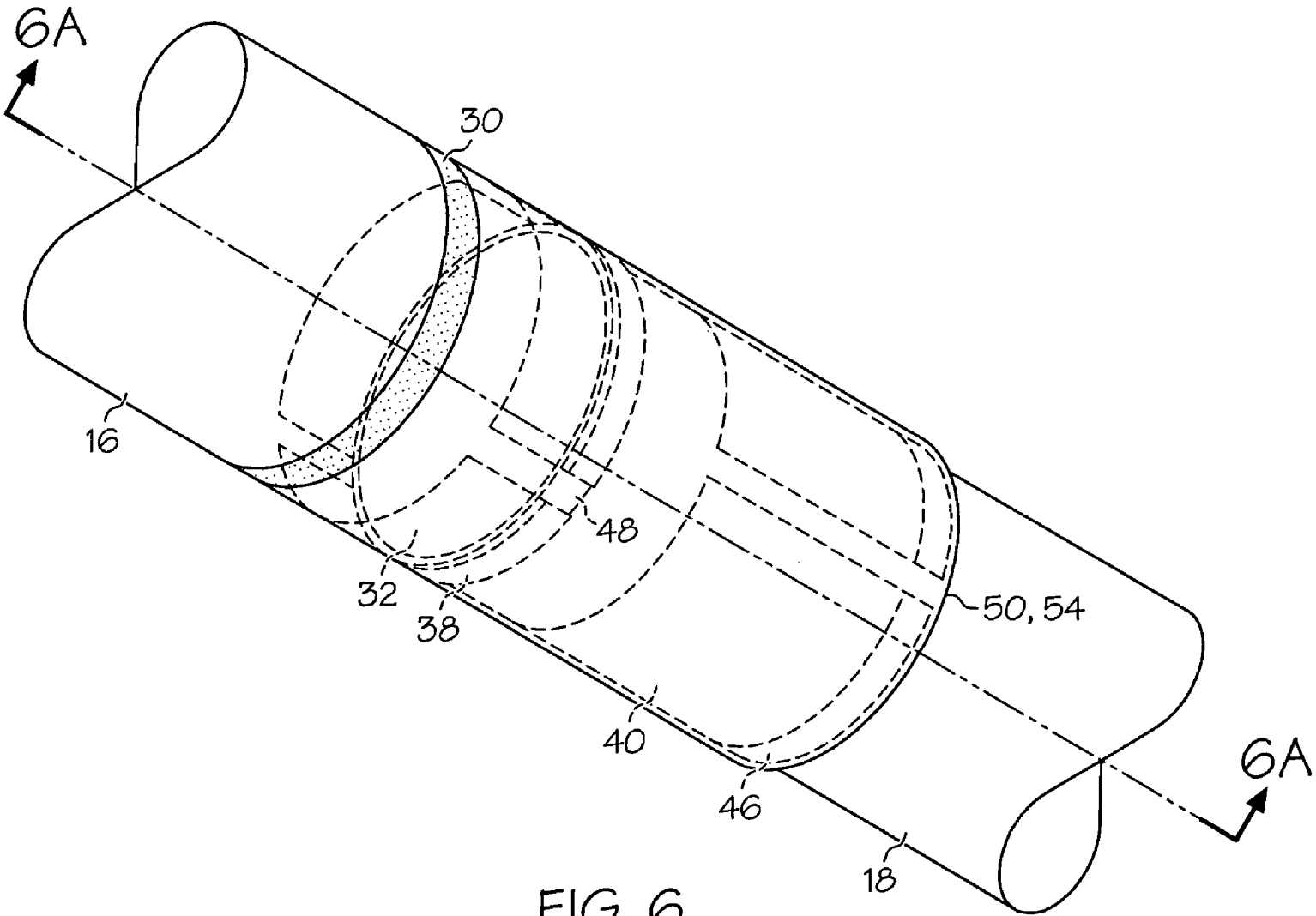
Figure 6A:
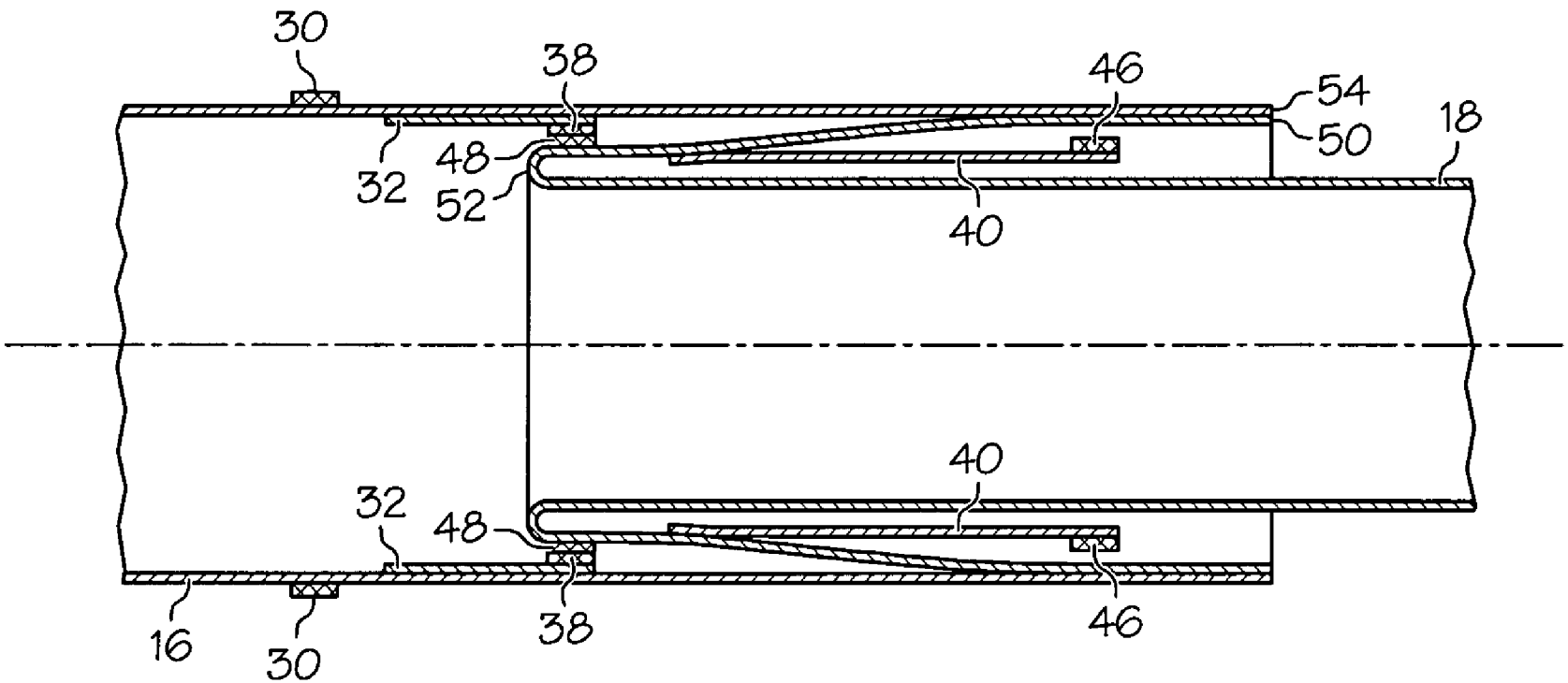

In order to couple the upper 16 and lower 18 leg portions, as shown in FIGS. 5 and 5A, each lower leg portion 18 is partially inverted, or folded back upon itself. In particular, the upper edge 50 of the lower leg portion 18 is folded back to the position as shown in FIGS. 5 and 5A forming a folded edge 52. In the configuration shown in FIGS. 5 and 5A, the band 48 of hook-and-loop fastening material is exposed, and the flaps 40 are covered by the "folded-over" portion of the lower leg portion 18. Next, as shown in FIGS. 6 and 6A, the folded lower leg portion 18 is inserted into the upper leg portion 16 until the folded edge 50 of the lower leg portion 18 is generally aligned with the lower edge 54 of the upper leg portion 10. At this point, the band 48 of hook-and-loop fastening material of the lower leg portion 18 is generally aligned with the hook-and-loop fastening material 38 of the flaps 32 of the upper leg portion 16. Accordingly, the portions 38, 48 of hook-and-loop fastening material are then pressed together to couple those components (alternately, this may be completed at a later stage).

Figure 7:
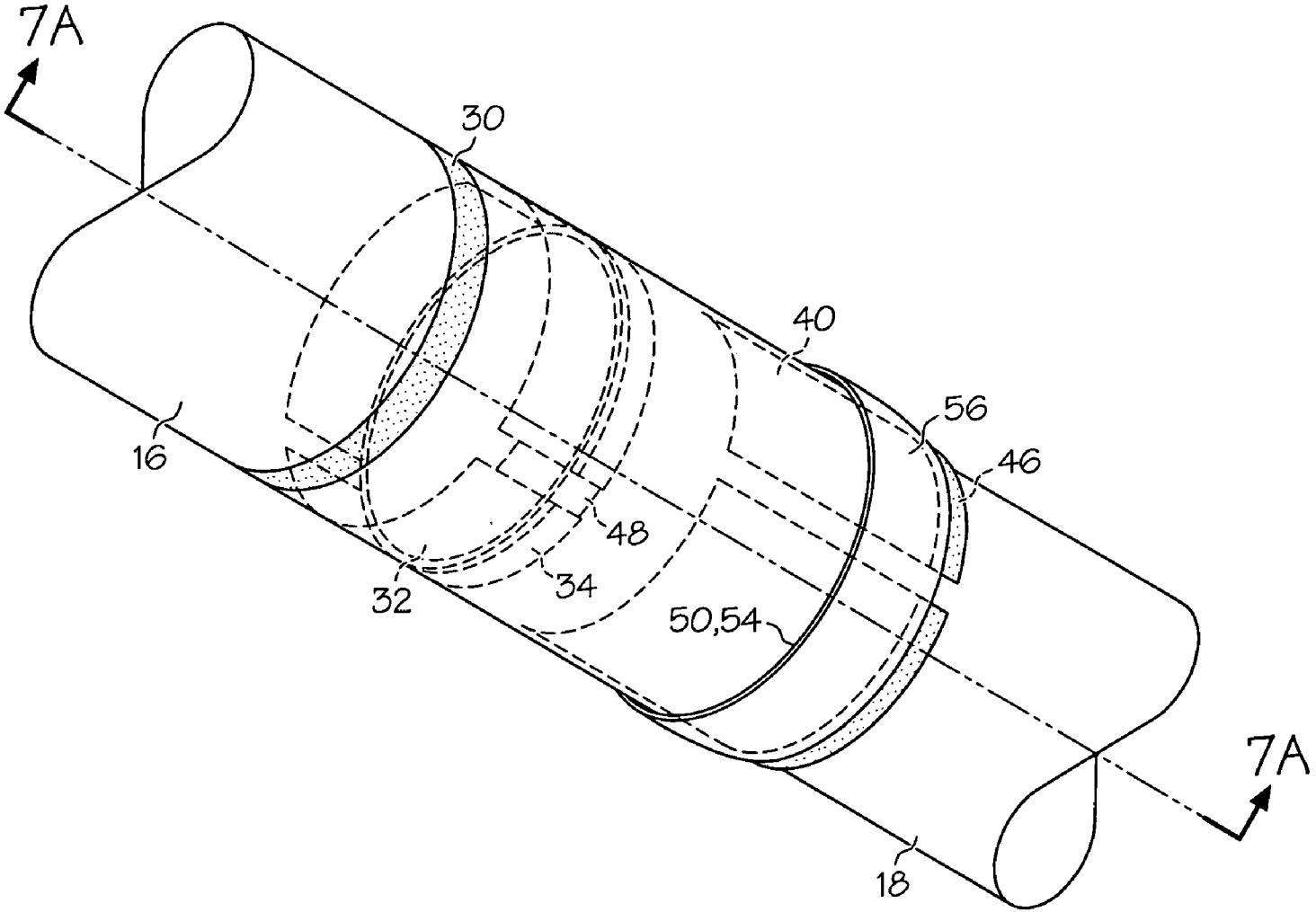
Figure 7A:
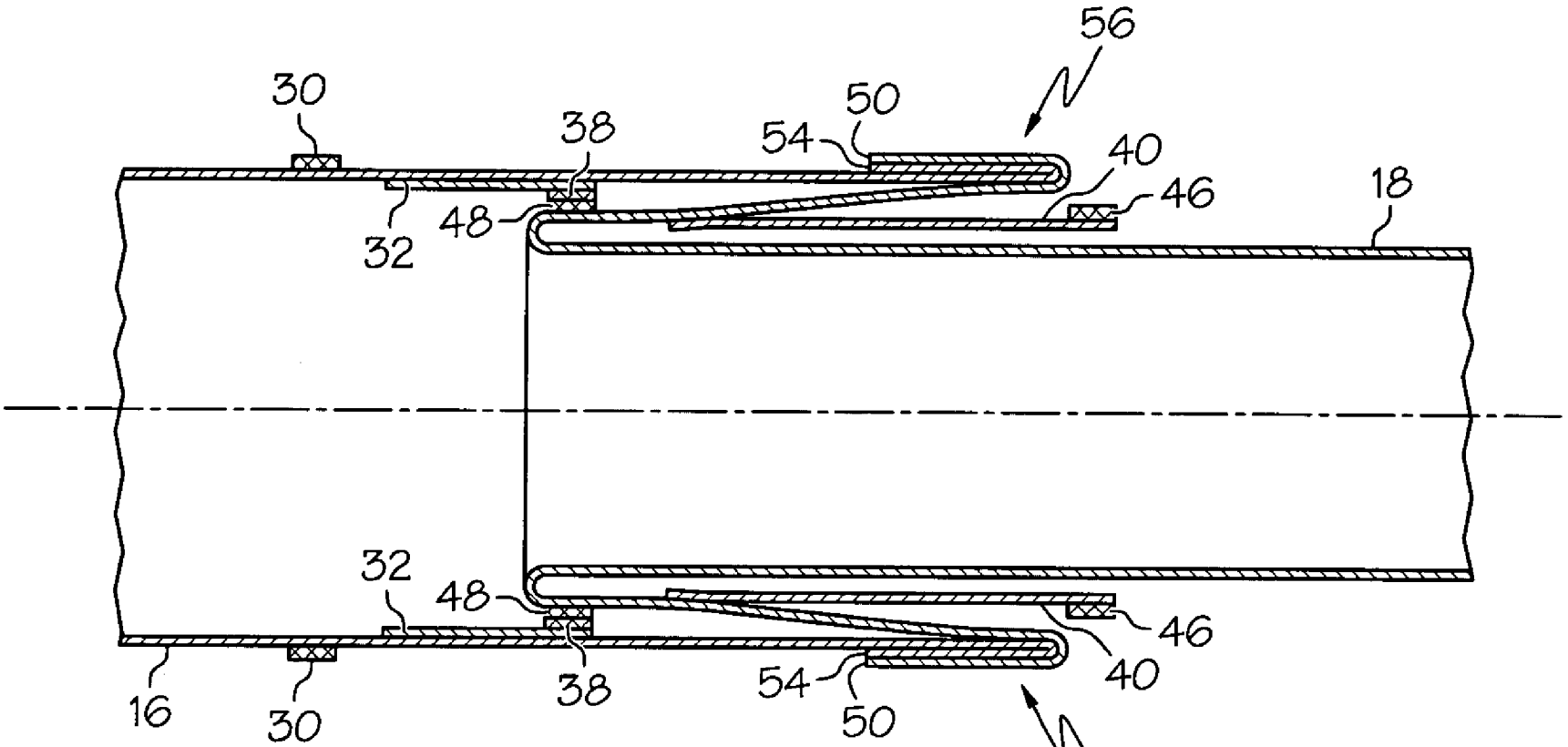
Figure 8:
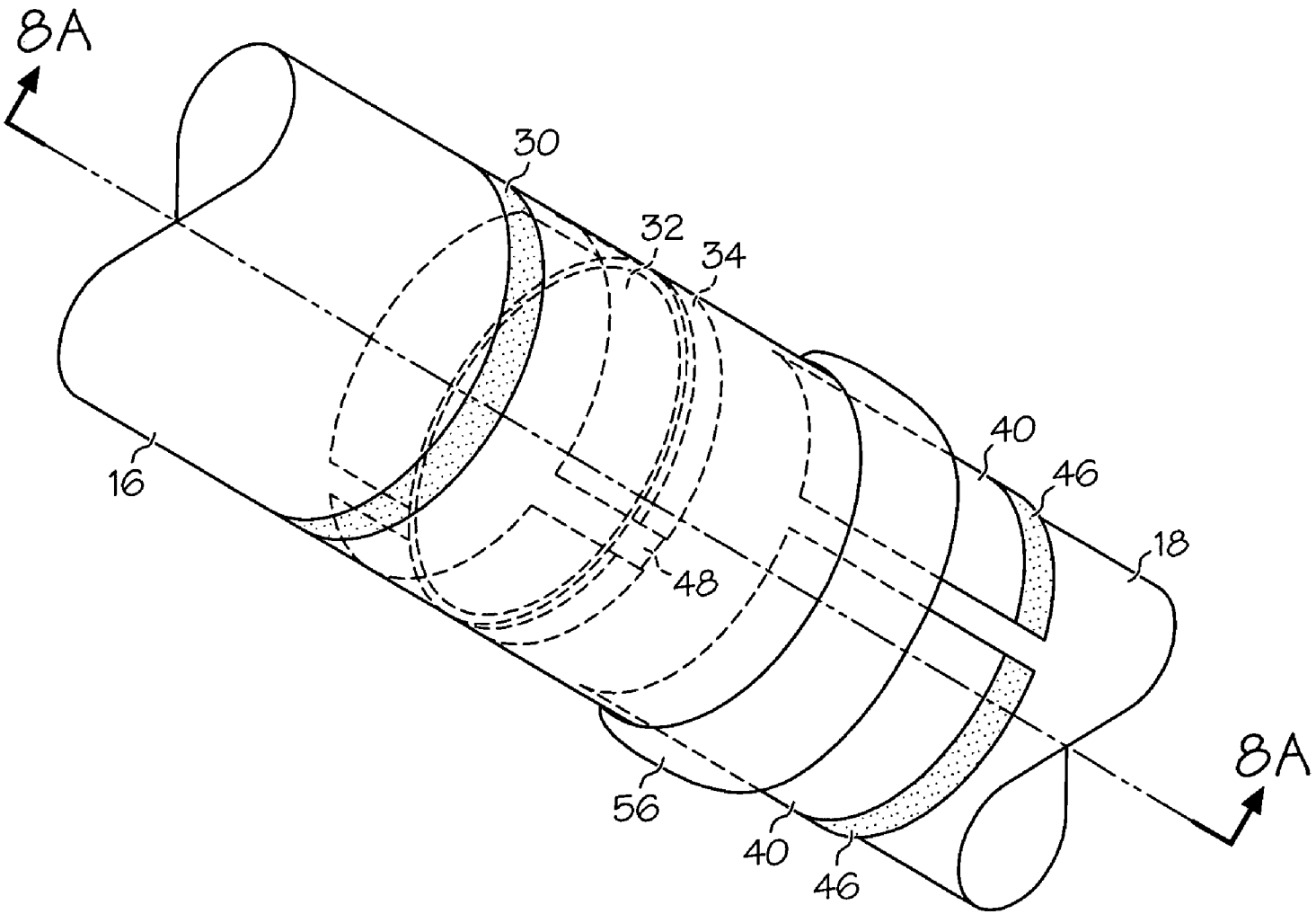
Figure 8A:
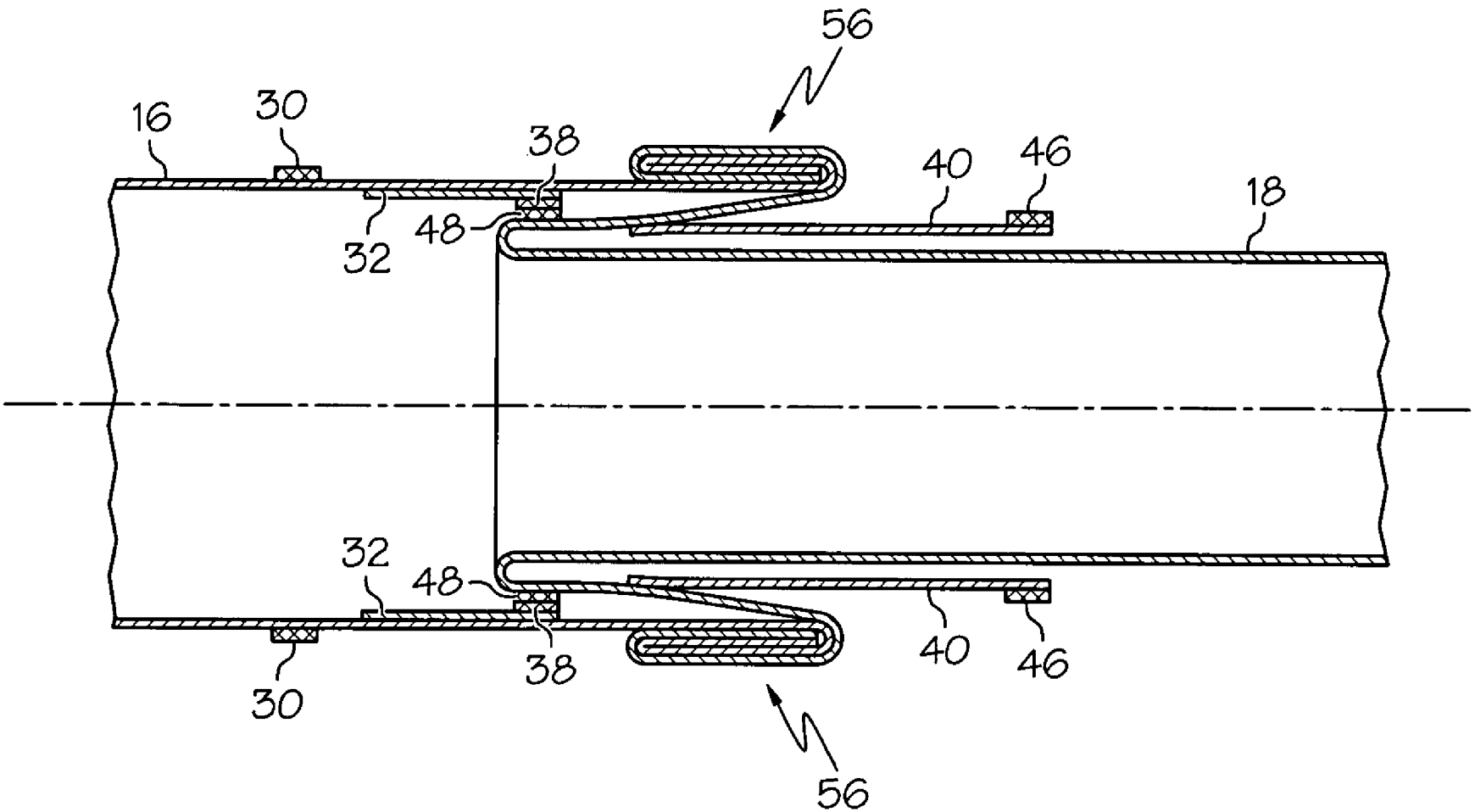

Next, as shown in FIGS. 7 and 7A, the portions of the upper 16 and lower 18 leg portion adjacent to the aligned edges 50, 54 are folded once to form a folded portion 56 (shown as a four-ply section in FIG. 7A). This folded portion 56 is folded over a second (FIGS. 8 and 8A) and third (FIGS. 9 and 9A) time until the flaps 40 of the lower leg portion 18 are fully exposed. These folding steps are provided to help ensure a robust seal by the frictional and compression forces between the upper 16 and lower 18 leg portions, and in particular with respect to the barrier layer 24 thereat.

Figure 9:
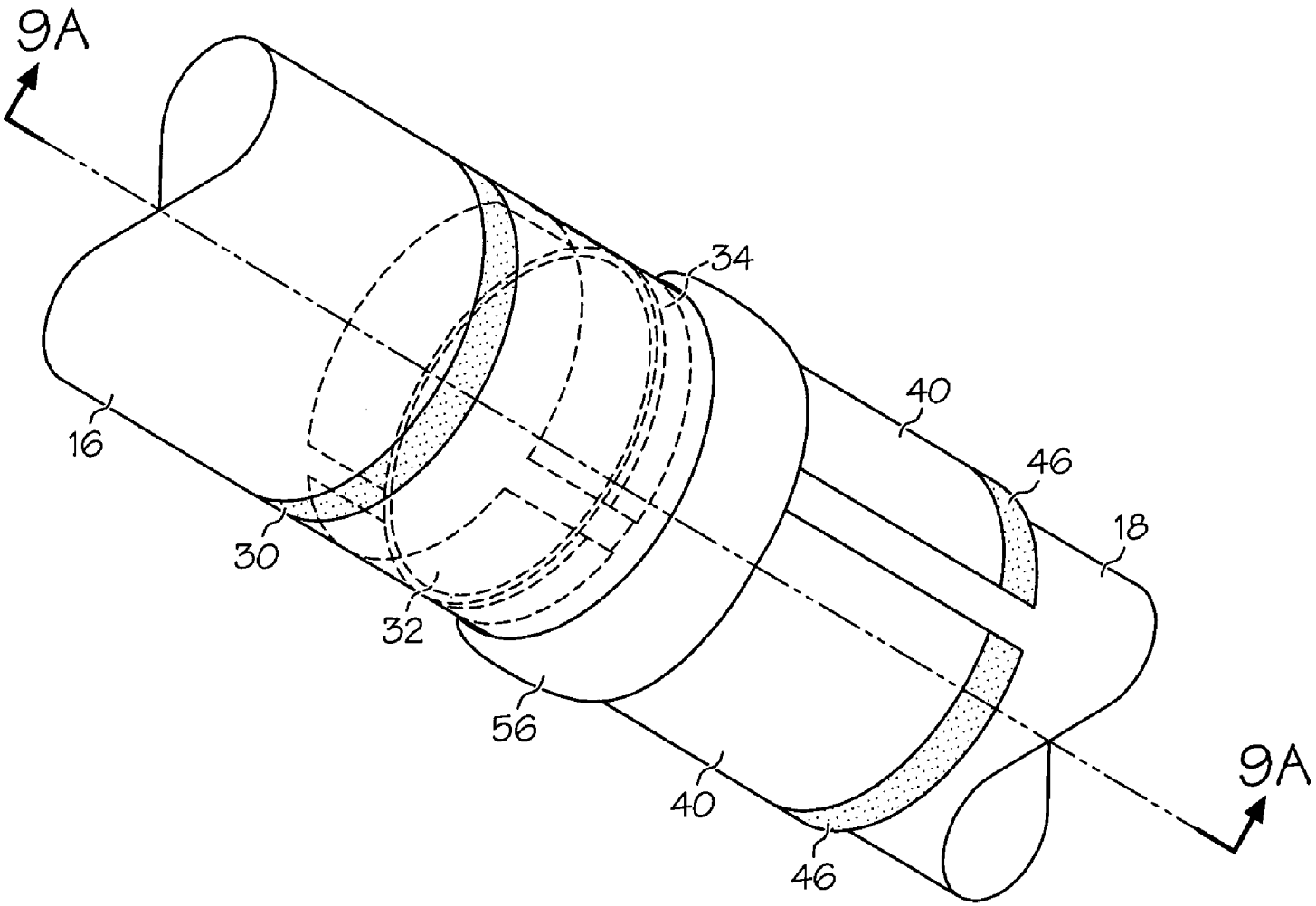
Figure 9A:
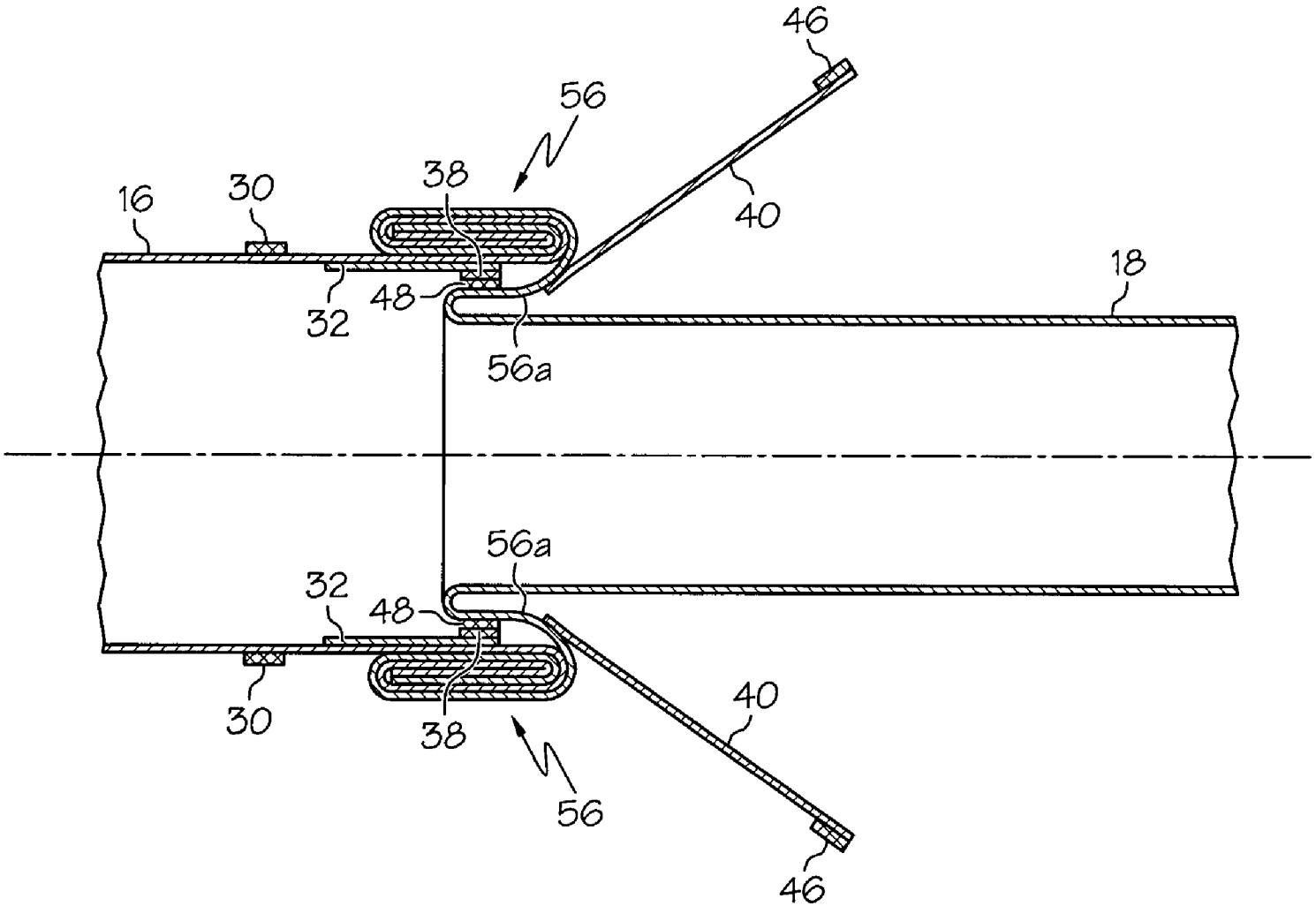

After these folding steps are completed, a seven-ply thickness folded stack 56 is provided (wherein each layer of the upper 16 and lower 18 portions are considered a single "ply" for these purposes, even though those portions 16, 18 may include various layers and sub-layers, as described above). As shown in FIG. 9A, the "eighth" ply or layer 56*a* of the folded portion 56 may deviate a bit from the remainder of the folded portion 56 to provide a connection to the rest of the lower leg portion 18. Moreover, if desired, only a single fold or double fold (instead of a triple fold) may be utilized (i.e. the steps of FIG. 8 and/or FIG. 9 may be omitted, resulting in a four ply or six ply folded portion 56), or additional folding steps (such as a quadruple fold, etc.) may be implemented. Having at least a six-ply folded portion 56 may provide a minimum for an acceptable seal at the joint 56. In addition, if desired a double-sided releasable adhesive may be placed between the portions 16, 18, and/or folds thereof, in the stack 56 to aid in sealing the joint. The use of the double sided releasable adhesive may help to form a seal at the joint, and may in certain cases allow the number of folds to be decreased.

Figure 10:
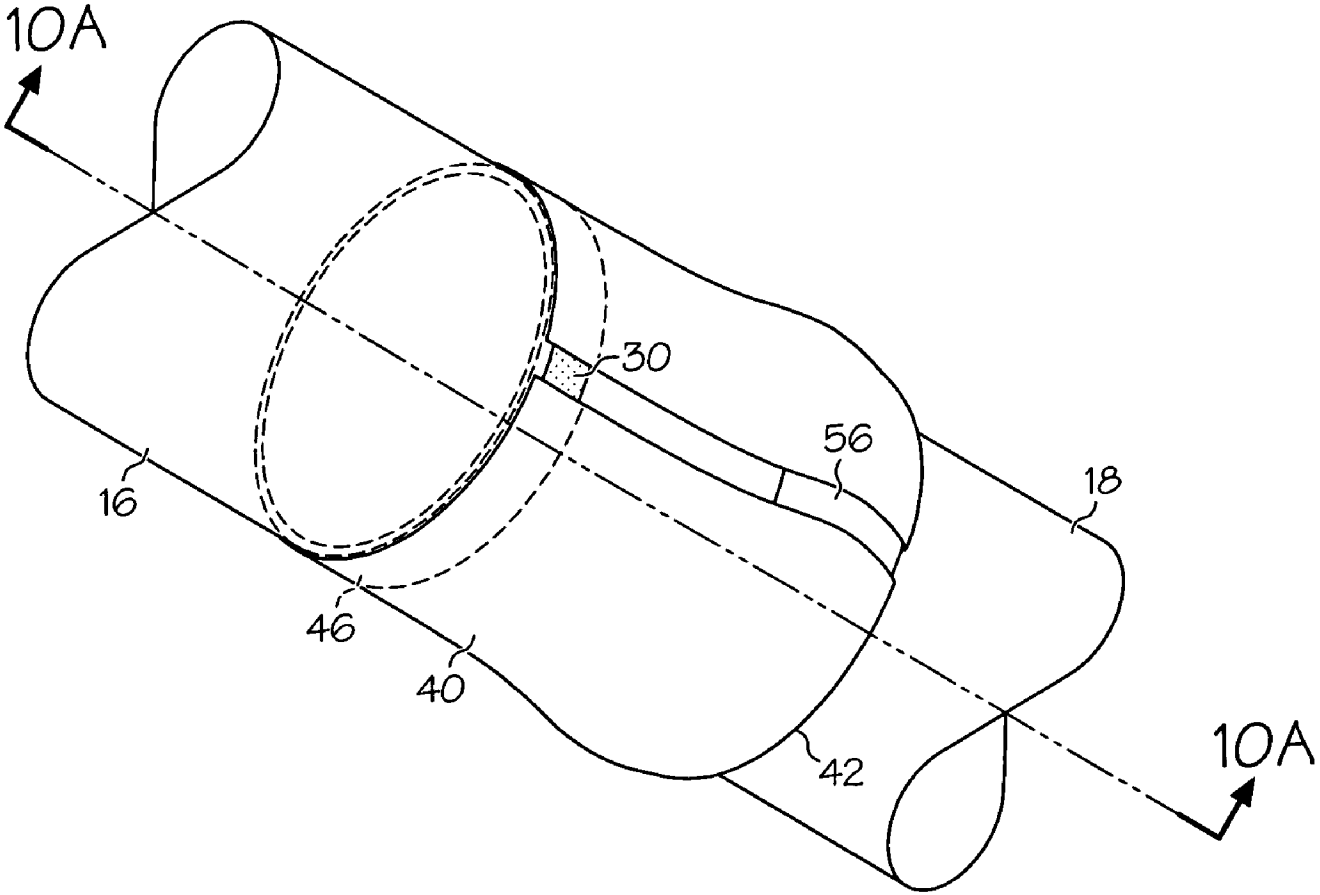
Figure 10A:
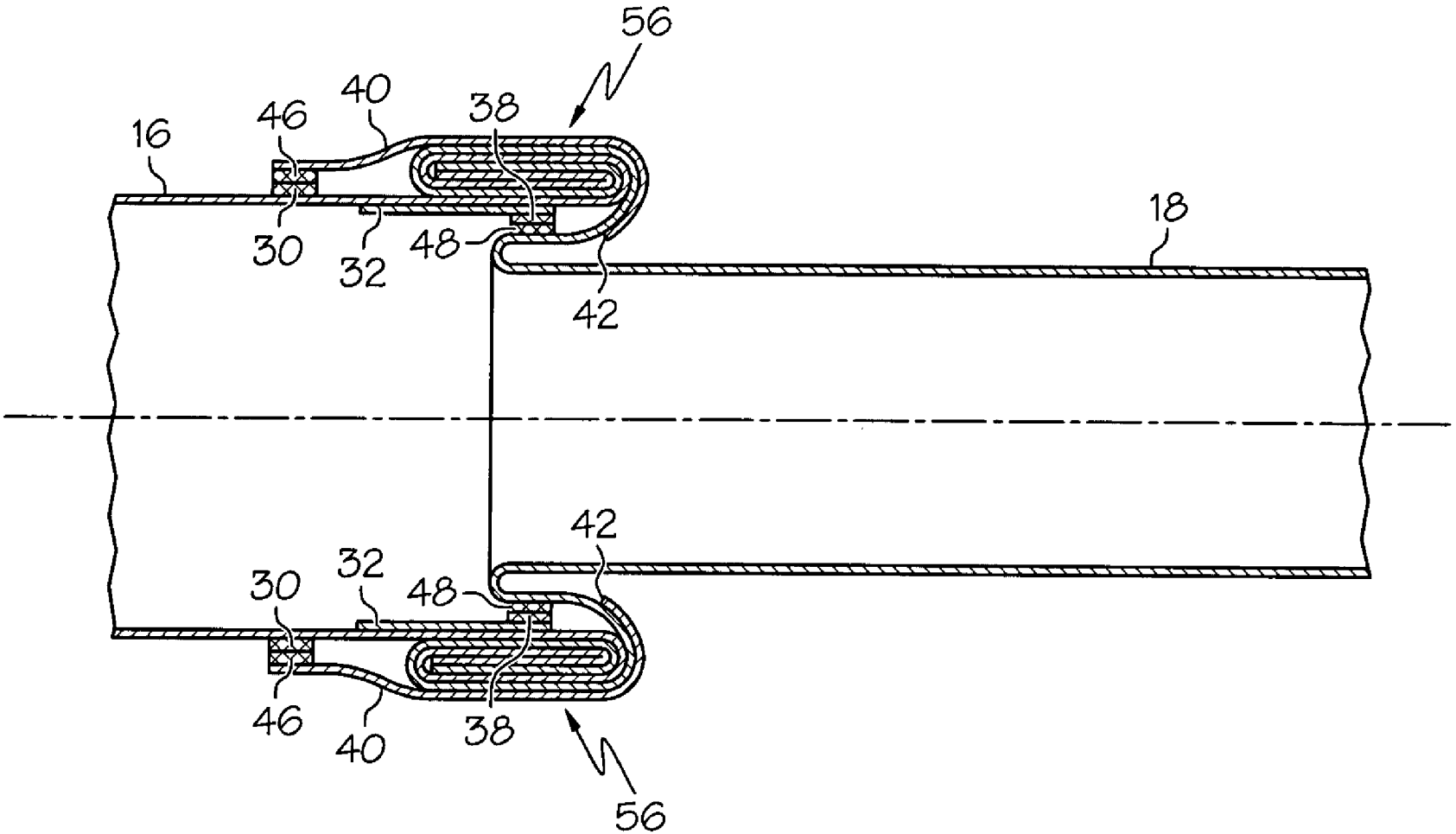
Figure 11:
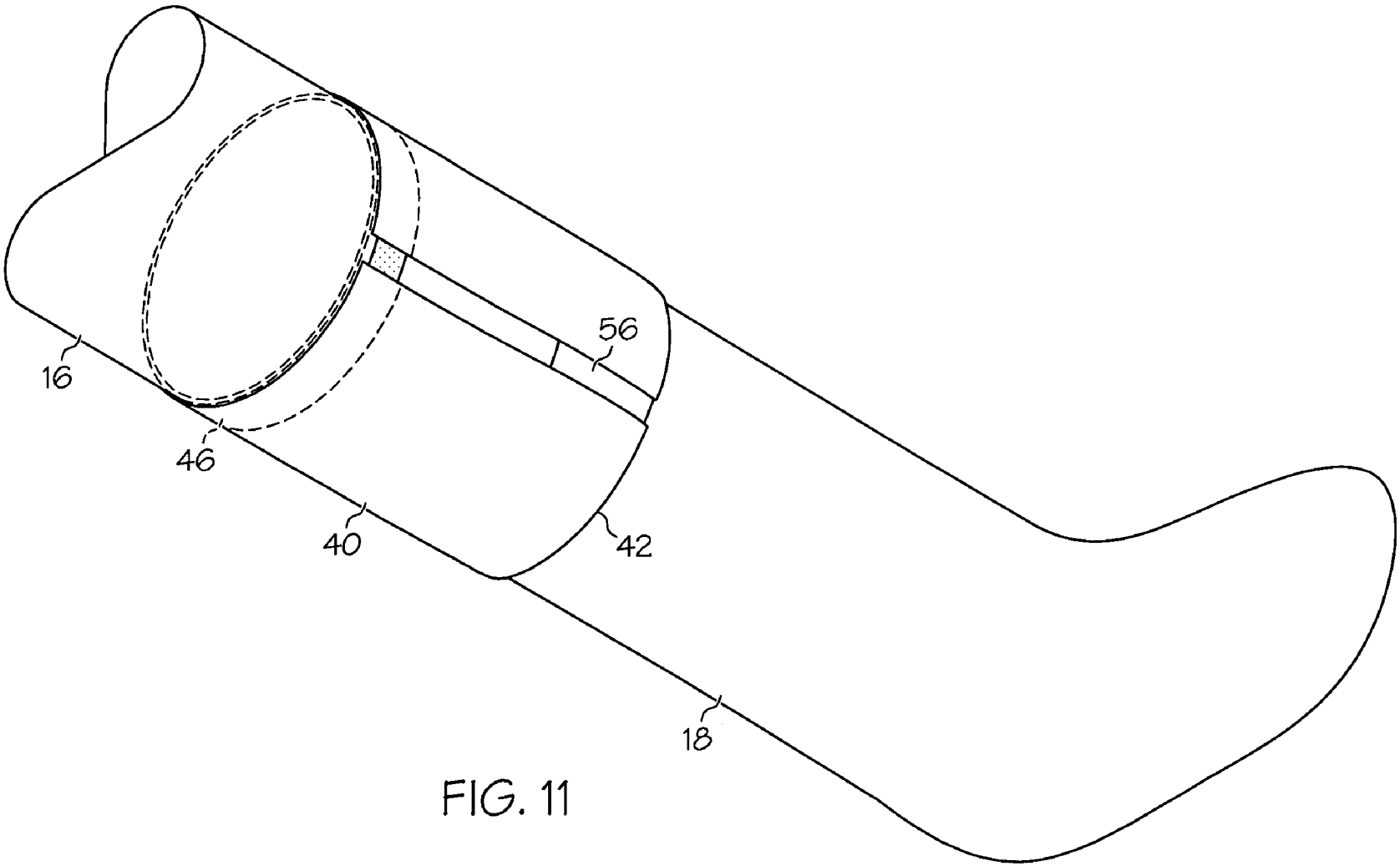

Next, as shown in FIGS. 10 and 10A, the flaps 40 of the lower leg portion 18 are folded about their edges 42 over the folded portion 56 and attached to the band 30 of hook-and-loop fastening material of the upper leg portion 16. Next, the lower leg portion 18 is pulled downwardly (away from the upper leg portion 16) to pull out any folds or creases in the leg portions 16, 18, resulting in the configuration shown in FIG. 11. The attachment steps can then be repeated to attach the other lower leg portion 18 to the body portion 16.

In order to decouple the lower leg portions 18, the steps outlined above are reversed. Accordingly, the attachment system shown herein provides a robust and secure attachment method for securing the lower leg portions 18 and upper leg portions 16, while still providing a sufficient seal therebetween. The portions 56 of the upper 16 and lower 18 leg portion are folded in a generally coiled, nested or serpentine manner and somewhat compressed to help to provide the seal joint between the upper 16 and lower 18 leg portions. In addition, the two, spaced apart separate hook and loop fastener joints 38/48 and 30/46 are positioned on either side of the folded portion 56 to provide structural strength to the joint. The folded portion/joint 56 is generally positioned between the outer flap 40 and inner flap 32 in a thickness direction of the trousers 10 to provide further protection and strength to the joint.

The folded portion 56 and/or the flaps 32, 40 and corresponding releasable attachments 30, 38, 46, 48, and various combinations thereof, can constitute a fluid, gas, aerosol and/or vapor-tight seal or joint between the leg portions 16, 18. Thus, this structure/method allows the lower leg portions 18 to be removed/replaced as desired to replace or service the lower leg portions 18, and allows for quick removal/replacement in the field or elsewhere.

Moreover, if desired, various other configurations for the pieces of hook-and-loop fastening material 30, 38, 46, 48 may be used. For example, the positions of the flaps 32, 40 (and associated hook and loop fastening material 38, 46) may be reversed such that the flaps 32 are located on the lower leg portion 18, and/or flaps 40 are located on the upper leg portion 16. The attachment method and structure described may also be used in the outer liner 12 instead of, or in addition to, the inner shell 14.

The joint 56 between the leg portions 16, 18 may be sufficiently air tight/vapor tight to meet and pass the NFPA Chem/Bio Option specifications, and thus can provide a sufficient joint without the use of mechanical fasteners. The attachment system disclosed herein may be cheaper and more lightweight than mechanical fasteners, and more robust in that there are no mechanical devices prone to fail. However, rather than, or in addition to, using hook-and-loop fastening material 30, 38, 46, 48, various other attachment mechanisms, including snaps, clasps, magnets, hooks, zippers and the like may be utilized. A fluid and/or vapor tight zipper may be also utilized, or a plastic zipper seal utilizing linear beads, such a seal to those analogous as found on ZIPLOC® plastic bags (also known as "press-to-close" zippers, or reclosable or releasable closures), but of a relatively most robust construction.

Figure 12:
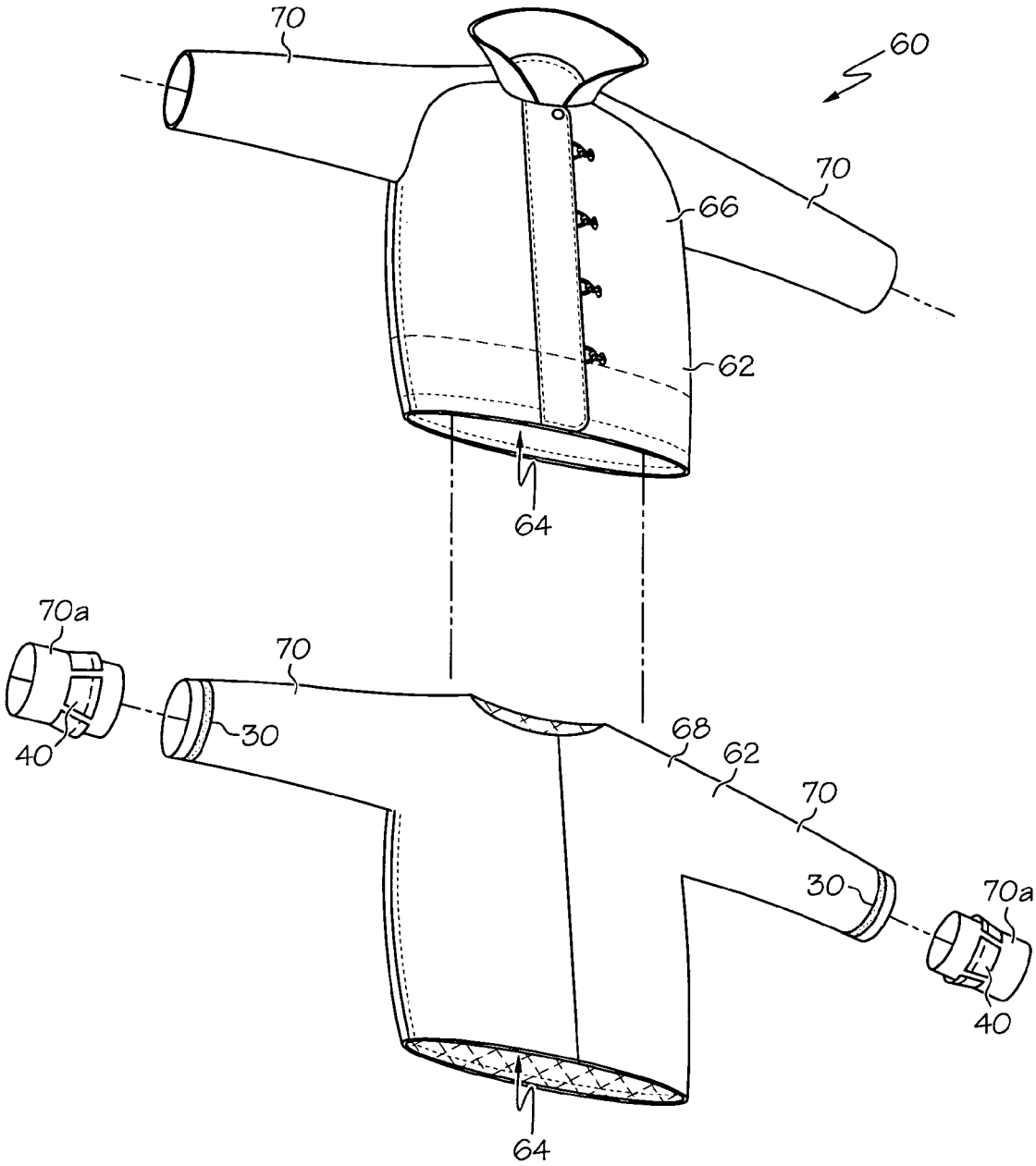
FIG. 12 is an exploded view of a coat.

The attachment method and structure described above for the trousers 10 may also be used with the liner of a coat 60, as shown in FIG. 12. The coat 60 may have the same construction/build-up of layers as any of the various arrangements for the trousers 10 described above. Thus, the coat 60 may include an outer shell 20, thermal liner or barrier 22, moisture/vapor barrier 24, and inner face cloth 26 in the same manner and having the same properties as described above in the context of the trousers 10. The coat 60 may include a body portion 62 defining a torso cavity 64 that is shaped to receive a wearer's torso therein. The coat 60 may have an outer liner 66 and an inner shell 68 which may have the same properties as the corresponding layers 12, 14 of the trousers 10 described above. The coat 60/inner shell 68 may include a pair of sleeves 70 coupled to and extending generally outwardly from the body portion 16 and may be shaped to receive a wearer's arms therein.

The sleeves 70, or detachable parts thereof 70*a*, may be removably attached in the same manner as the lower leg portions 18 of the trousers 10 described above. Thus the detachable portions 70*a* of the sleeves may extend to just below the elbow, or below the shoulder, although the detachable portion 70*a* can be otherwise configured as desired. The attachable/detachable sleeve portions 70*a* provide the same advantages with respect to replacement and repair, while still providing a robust connection and seal, as described above in the context of the lower leg portions 18 of the trousers 10.

Figure 13:
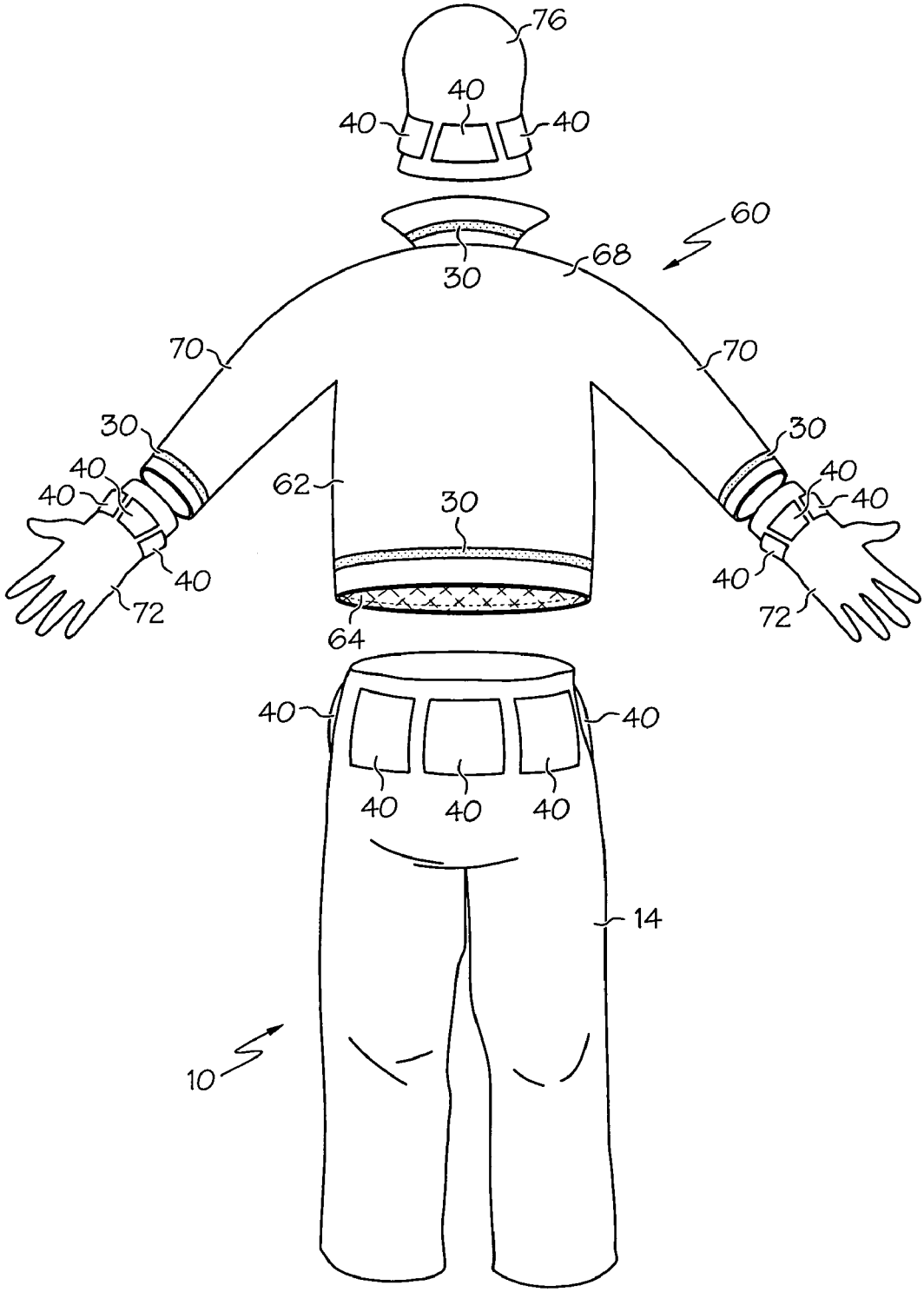
FIG. 13 is an exploded view of coat, gloves, trousers and hood assembly.

Alternately, rather than being solely a sleeve portion 70*a*, the detachable portion may constitute gloves 72, as shown in FIG. 13. In that embodiment, the gloves 72 (or sleeve portions 70*a* of FIG. 12 that are integral with the gloves 72) may be detachably coupled to the sleeves 70 using the structure and method disclosed herein. Moreover, as shown in FIG. 13, the trousers 10 (or an inner shell 14 thereof) may be detachably and sealingly connected to the coat 60 (or an inner shell 68 thereof) about a perimeter of the waists of those garments 10, 60/shells 14, 68. Although the trousers 10 may include a fly opening in the front formed in the outer liner 12, the inner shell 14 of the trousers 10 (or the barrier portion 24 thereof) may be generally continuous adjacent to the fly (i.e., may lack a slit or a fly), thereby ensuring ease of use of the coupling structure and method disclosed herein. The use of a sealed coupling between the trousers 10 and the coat 60 may allow use of a two-piece (or more) garment assembly in hazardous environments, which is easier to don, doff, clean and repair, instead of a one-piece jumpsuit or the like.

As shown in FIG. 13, a hood 76 may be releasably sealingly coupled to the coat 60 about the collar/lower edge of the hood 76 using the method and structure disclosed herein. This arrangement allows the use of a detachable hood 76 for ease of cleaning, repair, etc., but with a sealing connection. When a sealingly engaged hood 76 is used, the wearer may also wear a helmet, face mask or the like which sealingly engages with the hood 76 to help isolate the wearer from any hazardous environments. The method and structure disclosed herein can be used to detachably, yet sealingly, attach various other garments and parts thereof together to provide the advantages specified herein.

Although the invention is shown and described with respect to certain embodiments, it should be clear that modifications will occur to those skilled in the art upon reading and understanding the specification, and the present invention includes all such modifications.

What is claimed is:

1. A protective garment comprising:

a first portion which is generally impermeable to gases; and a second portion which is generally impermeable to gases, wherein said second portion is releasably coupled to said first portion at a joint which is generally impermeable to gases, and wherein said joint is at least partially formed by nestingly folded portions of said first and second portions.

2. The garment of claim 1 further comprising an outer shell, and wherein said first and second portions are generally positioned inside said outer shell such that said first and second portions are configured to be positioned between said outer shell and a wearer when said garment is worn, and wherein said outer shell is generally continuous in the area where said second portion is coupled to said first portion.

3. The garment of claim 1 said first portion forms a seal with said second portion at said joint.

4. The garment of claim 1 wherein said second portion is manually releasably coupled to said first portion such that said second portion and said first portion are manually releasably coupleable.

5. The garment of claim 1 wherein said second portion is releasably coupled to said first portion by hook and loop fastening material.

6. The garment of claim 1 wherein said first portion is a body portion and said second portion is an extremity.

7. The garment of claim 6 wherein said protective garment is a pair of trousers, and wherein said body portion is configured to receive the lower part of the torso and the upper part of the legs of a wearer, and wherein said at least one extremity is configured to receive the lower part of the leg of a wearer.

8. The garment of claim 1 wherein said first portion is a coat and said second portion is a pair of trousers.

9. The garment of claim 1 wherein the garment conforms with National Fire Protection Association 1971 Standards for Protective Firefighting Garments, and the Chem/Bio Option thereof.

10. A protective garment comprising:

an outer shell;

a first portion which is generally impermeable to gases; and a second portion which is generally impermeable to gases, wherein said second portion is releasably coupled to said first portion at a joint which is generally impermeable to gases, and wherein said first and second portions are generally positioned inside said outer shell such that said first and second portions are configured to be positioned between said outer shell and a wearer when said garment is worn, wherein said joint is at least partially formed by nested, folded portions of said first and second portions.

11. The garment of claim 10 wherein said outer shell lacks any releasably connectable portions in the area where said second portion is coupled to said first portion.

12. The garment of claim 10 wherein said outer shell is not generally impermeable to gases.

13. The garment of claim 10 wherein said outer shell resists igniting, burning, melting, dripping or separation when exposed to a temperature of 500° F. for at least five minutes.

14. The garment of claim 10 further comprising a thermal barrier located generally inside the outer shell such that said thermal barrier is positioned between the outer shell and a wearer when said garment is worn, wherein said thermal barrier has a thermal protection performance of at least about twenty.

15. The garment of claim 1 wherein said first portion, said second portion, and said joint are each generally impermeable to fluids, gases, vapors, aerosols and particulates.

16. The garment of claim 1 wherein said first portion, said second portion, and said joint are each generally impermeable to water vapor.

17. The garment of claim 1 wherein said joint is generally impermeable to gases such that gases outside of said garment are generally precluded from entering said garment via said joint.

18. A protective garment comprising:

a first portion; and a second portion releasably coupled to said first portion at a joint, said joint including portions of said first portion and said second portion nestingly folded to form at least a six-ply section.

19. The garment of claim 18 wherein said first portion is a body portion and said second portion is an extremity.

20. The garment of claim 18 wherein said first portion is considered a single ply at positions away from said joint and said second portion is considered a single ply at positions away from said joint.

21. The garment of claim 18 wherein said portions of said first and second portions are nestingly folded at least three times to form said at least six-ply section.

22. The garment of claim 18 wherein said folded portion of said first portion is generally impermeable to gases, and said folded portion of said second portion is generally impermeable to gases, wherein said joint is generally impermeable to gases.

23. The garment of claim 18 further comprising an outer shell, wherein said first and second portions are positioned inside said outer shell such that said first and second portions are configured to be positioned between said outer shell and a wearer when said garment is worn.

24. The garment of claim 23 wherein said outer shell is generally continuous in areas adjacent to said joint.

25. A method for assembling a garment comprising:

accessing a first portion which is generally impermeable to gases;

accessing a second portion which is generally impermeable to gases;

positioning a part of said second portion adjacent to a part of said first portion; and manually nestingly folding said adjacent portions to form a joint and releasably attaching said second portion to said first portion at said joint, whereby said joint is generally impermeable to gases.

26. The method of claim 25 wherein said second portion forms a seal with said first portion at said joint.

27. A method for assembling a garment comprising:

accessing a first portion which is generally impermeable to gasses;

accessing a second portion which is generally impermeable to gasses;

positioning a part of said second portion adjacent to a part of said first portion;

manually folading said adjacent portions to form a joint and releaseably attaching said second portion to said first portion at said joint, whereby said joint is generally impermeable to gasses and wherein said manually folding step includes folding said adjacent portions at least three times to form at least a six-ply section.

28. The method of claim 25 wherein said first portion includes a portion of hook-and-loop fastening material, and said second portion has a portion of hook-and-loop fastening material, and wherein the method includes the step of releasably coupling the portions of hook-and-loop fastening material.

29. The method of claim 25 further comprising the step of, prior to said releasably attaching step, inverting an end of one of said first or second portions.

30. The method of claim 29 further comprising the step of, after said inverting step, inserting said inverted end into the other one of said first or second portions such that a distal end of said inverted end is generally aligned with a distal end of the other one of said first or second portions.

31. The method of claim 30 further comprising the step of folding said aligned ends to form said joint.

32. The method of claim 25 further comprising the step of positioning said first and second portions inside an outer shell such that said first and second portions are configured to be positioned between the outer shell and a wearer when said garment is worn, and wherein said outer shell is generally continuous in the area where said second portion is coupled to said first portion.

33. The garment of claim 10 wherein said outer shell is generally continuous in the area where said second portion is coupled to said first portion.

34. A protective garment comprising:

a first portion which is generally impermeable to gases; and a second portion which is generally impermeable to gases, wherein said second portion is releasably coupled to said first portion at a joint which is generally impermeable to gases, and wherein said joint is at least partially formed by folded portions of said first and second portions;

wherein said joint includes portions said first and second portions nestingly folded to form at least a six-ply section.

35. The garment of claim 34 further comprising a flap fixedly coupled to one of said first or second portions and releasably coupled to the other one of said first or second portions, and wherein said flap is positioned immediately adjacent to said joint.

36. The garment of claim 35 wherein said flap is positioned outside said joint such that said joint is positioned between said flap and a wearer of said garment when said garment is worn.

37. The garment of claim 35 wherein said flap is positioned inside said joint such that said flap is generally positioned between said joint and a wearer of said garment when said garment is worn.

38. The garment of claim 35 further comprising a supplemental flap fixedly coupled to one of said first or second portions and releasably coupled to the other one of said first or second portions, and wherein said joint is positioned generally between said flap and said supplemental flap in a thickness direction of said garment.

* * * * *

UNITED STATES PATENT AND TRADEMARK OFFICE

CERTIFICATE OF CORRECTION

PATENT NO. : 7,996,920 B2
APPLICATION NO. : 12/421666
DATED : August 16, 2011
INVENTOR(S) : Aldridge It is certified that error appears in the above-identified patent and that said Letters Patent is hereby corrected as shown below:

Claim 3, Col. 8, Line 62, insert -- wherein -- before "said".

Claim 27, Col. 10, Line 34, replace "folading" with -- folding --.

Signed and Sealed this
Eleventh Day of October, 2011

David J. Kappos

David J. Kappos
*Director of the United States Patent and Trademark Office*